United States Patent [19]

Gerber

[11] 4,359,525

[45] Nov. 16, 1982

[54] METHOD OF PREPARING A PHOTOSENSITIVE SILVER HALIDE ELEMENT

[75] Inventor: Arthur M. Gerber, Belmont, Mass.

[73] Assignee: Polaroid Corporation, Cambridge, Mass.

[21] Appl. No.: 323,936

[22] Filed: Nov. 23, 1981

[51] Int. Cl.[3] ..... G03C 5/26; E03C 1/02

[52] U.S. Cl. ..... 430/567; 430/496; 430/564; 430/932; 430/524

[58] Field of Search ..... 430/495, 496, 523, 524, 430/564, 567, 569, 631, 932

[56] References Cited

U.S. PATENT DOCUMENTS 3,455,239 7/1969 Smith ..... 219/121 LJ

FOREIGN PATENT DOCUMENTS

WO80/01614 8/1980 PCT Int'l Appl. ..... 430/7

OTHER PUBLICATIONS

Shepp et al., "Evaporated Silver Bromide as a Photographic Recording Medium," Photo. Sci. & Eng. vol. 11 No. 5 Sep. Oct. 1967, pp. 316–321.

*Primary Examiner*—Mary F. Downey
*Attorney, Agent, or Firm*—Philip G. Kiely

[57] ABSTRACT

A photosensitive silver halide element comprising a support carrying single effective silver halide grains in a predetermined spaced array is prepared by coalescing fine-grain silver halide in a plurality of spaced depressions in a surface by melting said fine-grain silver halide.

9 Claims, No Drawings

METHOD OF PREPARING A PHOTOSENSITIVE SILVER HALIDE ELEMENT

BACKGROUND OF THE INVENTION

Copending application of Edwin H. Land, Ser. No. 234,937, filed Feb. 17, 1981, (commonly assigned) is directed to a method for forming a predetermined spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain and their geometric layout will conform to the original configuration of the sites.

Copending application of Arthur M. Gerber, Ser. No. 298,640, filed Sept. 2, 1981, (common assignee) is directed to a method for forming a photosensitive element comprising a plurality of single effective silver halide grains, which method comprises coalescing fine-grain silver halide in a plurality of predetermined spaced depressions. Preferably, the coalescence is effected by contacting fine-grain silver halide with a solution of silver halide solvent.

Copending application of Edwin H. Land and Vivian K. Walworth, Ser. No. 298,638, filed Sept. 2, 1981, (common assignee) is directed to a method of forming a photosensitive element comprising a plurality of single effective silver halide grains, which method comprises coalescing a fine-grain emulsion in a plurality of predetermined spaced depressions by contacting said fine-grain emulsion with a solution of a silver halide solvent containing a dissolved silver salt.

Copending application of Vivian K. Walworth, Ser. No. 298,637, filed Sept. 2, 1981, is directed to a method of forming a photosensitive element comprising a plurality of single effective grains in a predetermined spaced array which comprises coalescing a fine-grain silver halide emulsion in a plurality of predetermined spaced depressions in a surface, where said coalescence is carried out by contacting said fine-grain emulsion with a silver halide solvent in the vapor phase.

The term, "single effective silver halide grain", refers to an entity at each site which functions photographically as a single unit which may or may not be crystallographically a single crystal but one in which the entire unit can participate in electronic and ionic processes such as latent image formation and development.

It is known in the art that silver halide prepared by evaporation techniques show photographic recording properties. Such evaporation is achieved by heating silver halide to a temperature in excess of its melting point in a vacuum evaporation system. See, for example, Photographic Science and Engineering, Vol. 11, No. 5, Sept.-Oct. 1967, pages 316-321.

SUMMARY OF THE INVENTION

A photosensitive silver halide element comprising a support carrying photosensitive silver halide grains in a predetermined spaced array is prepared by a method which comprises coalescing fine-grain silver halide in a plurality of spaced depressions in a surface, wherein said coalescence is carried out by melting said fine-grain silver halide.

DETAILED DESCRIPTION OF THE INVENTION

The present invention is directed to a method for forming a photosensitive element comprising a support carrying photosensitive silver halide grains in a predetermined spaced array which comprises the steps of 1. depositing fine-grain silver halide in a plurality of spaced depressions in a surface, and
2. heating said fine-grain silver halide to a temperature sufficient to melt said fine-grain silver halide whereby single effective silver halide grains are formed in substantially each of said spaced depressions.

To carry out the novel method of the present invention fine-grain silver halide is applied to a substrate comprising a predetermined spaced array of depressions in a surface. If applied in a moist or wet form, the fine-grain silver halide is dried to help prevent the grains from being dislodged from the depressions during subsequent handling. It is also preferred that care be taken to remove as much as possible from the plateaus between the depressions, since coalescence by melting, unlike coalescence by action of a silver solvent, will not wash the fine-grain silver halide off the plateaus and into the depressions. The fine-grain silver halide contained in the depressions is then heated to a temperature at least equal to the melting point of the silver halide to melt the silver halide thereby forming a single effective silver halide grain.

Any suitable means may be employed to melt the silver halide, including furnaces, induction heating and laser beam annealing.

The term, "fine-grain silver halide", as used herein is intended to refer to silver halide grains the size of which would permit a number of grains to be deposited within each depression and also sufficiently small to substantially conform to the contours of the depressions. Preferably, silver halide grains between about 0.01 and 0.50 μm in diameter are employed. Particularly preferred is a silver halide emulsion having a grain size with an average diameter of about 0.1 μm or less.

The fine-grain silver halide may be in the form of an emulsion whereupon the binder would be vaporized during the coalescence step. Preferably, the silver halide would be employed as a binder-free powder or slurry.

It is also preferred that surfactants be employed to facilitate coating of the fine-grain silver halide in the depressions. In a preferred embodiment, the surfactants comprise a combination of AEROSOL OT (dioctyl ester of sodium sulfosuccinic acid) American Cyanamid Co., Wayne, N.J., and MIRANOL J2M-SF (dicarboxcylic caprylic derivative sodium salt) Miranol Chemical Co., Inc., Irvington, N.J., in a 1 to 3 ratio by weight, respectively, at about a 0.1% concentration by weight, based on the weight of the silver halide.

The matrix or substrate containing the depressions may be formed of any suitable material which can withstand the temperature employed in the silver halide melting step. The matrix may be formed by any technique known to the art for producing a micropattern of a regular spaced array of depressions in a surface, e.g., by the method set forth in copending application of James J. Cowan, Arthur M. Gerber and Warren D. Slafer, Ser. No. 234,959, filed Feb. 17, 1981.

The single effective silver halide grains formed by the novel method of the present invention may be employed in the matrix in which they are formed or they may be transferred to another layer according to the procedure set forth in copending application of Arthur M. Gerber, Warren D. Slafer, and Vivian K. Walworth, Ser. No. 298,639, filed Sept. 2, 1981 (common assignee). Thus, subsequent to single effective grain formation the matrix containing the single effective grains is laminated to a hydrophilic layer on a support and a liquid deposited therebetween. Upon separation the thus-formed single effective grains are transferred onto the hydrophilic layer from the depressions where they were formed. The liquid may comprise water or a solution of a polymeric thickener, such as gelatin.

The following non-limiting example illustrates the novel method of the present invention.

EXAMPLE 100 cc of a 1 M aqueous solution of silver nitrate and 100 cc of a 1 M solution of potassium bromide were mixed and the resulting precipitate was washed 10 times with distilled water. About 0.1 cc/100 g AgBr of surfactant consisting of a 1 to 3 ratio, by weight, of AEROSOL OT and MIRANOL J2M-SF, respectfully, was added to the silver bromide grains to facilitate coating. The suspension of grains was applied to an electroformed nickel substrate containing depressions about 1.2 μm in diameter, about 0.9 μm in depth and with a center-to-center spacing about 2.2 μm. Excess silver bromide was removed with a flat blade, the fine-grain silver bromide dried at about 150° C. and the surface again smoothed with a flat blade to remove excess silver halide. The nickel substrate containing the fine-grain silver halide was heated to about 600° C. for about 5 min. The initial light green color changed to dark green during the second heating step, indicating coalescence. Examination of the element by microscopy confirmed that coalescence had occurred.

The photographic element of the present invention may be chemically sensitized by conventional sensitizing agents known to the art.

Spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. In a preferred embodiment, the spectral sensitizing dye solution contains a polymeric binder material, preferably gelatin.

Additional optional additives, such as hardeners, viscosity-increasing agents, stabilizers, preservatives, and the like, also may be incorporated into the element.

I claim:

1. A method for forming a photosensitive element comprising a plurality of single effective silver halide grains in a predetermined spaced array which comprises coalescing fine-grain silver halide by heating said fine-grain silver halide at least to its melting point in a plurality of predetermined spaced depressions.

2. The method of claim 1 wherein said spaced depressions are in a substantially planar surface.

3. The method of claim 1 wherein said fine-grain silver halide is substantially binder-free.

4. The method of claim 1 wherein said fine-grain silver halide is a fine-grain silver halide emulsion.

5. The method of claim 1 which includes the step of depositing said fine-grain silver halide in said spaced depressions.

6. The method of claim 1 wherein said fine-grain silver halide includes a surfactant.

7. The method of claim 2 wherein said planar surface is nickel.

8. The method of claim 7 wherein said planar surface is electroformed nickel.

9. The method of claim 1 wherein said silver halide is silver bromide.

* * * * *